US005638906A

United States Patent [19]

McCabe

[11] Patent Number: 5,638,906

[45] Date of Patent: Jun. 17, 1997

[54] SAFETY IMPROVED FIRE EQUIPMENT ACCESS PANEL

[75] Inventor: Lance C. McCabe, San Clemente, Calif.

[73] Assignee: Potter-Roemer a division of Smith Industries Inc., Cerritos, Calif.

[21] Appl. No.: 559,690

[22] Filed: Nov. 15, 1995

[51] Int. Cl.[6] ..... A62C 35/20

[52] U.S. Cl. ..... 169/51; 312/138.1; 16/114 R

[58] Field of Search ..... 169/51; 312/138.1, 312/348.4; 16/114 R

[56] References Cited

U.S. PATENT DOCUMENTS 4,015,250 3/1977 Fudge ..... 169/51

4,034,697 7/1977 Russell ..... 169/51

4,763,732 8/1988 Neal ..... 169/51

5,323,511 6/1994 Gray ..... 16/114 R

*Primary Examiner*—Gary C. Hoge

*Attorney, Agent, or Firm*—Leonard Tachner

[57] ABSTRACT

A cabinet structure for a fire extinguisher has a glass door mounted in a frame. The glass is tempered glass, which shatters easily into small pieces upon cracking a portion thereof. A steel breaking lever is attached to an edge of the glass. When the breaking lever is rotated, it causes the glass to shatter into small, harmless pieces as a result of the inherent nature of built-in stresses in tempered glass, thus allowing access to the interior of the cabinet.

6 Claims, 2 Drawing Sheets

SAFETY IMPROVED FIRE EQUIPMENT ACCESS PANEL

BACKGROUND OF THE INVENTION

1. Field of the Invention

The present invention relates generally to fire equipment access panels such as the door of a fire extinguisher cabinet and more specifically to an improved fire access panel of the type in which glass is used to permit observation of the interior contents thereof and wherein a tempered glass and an edge breaking apparatus are used to prevent injury that may be incurred from large shards of broken annealed glass normally used in such panels.

2. Prior Art

Based upon a prior art search conducted by the applicant, the most relevant prior art appears to be the following:

U.S. Pat. No. 3,158,908 Springer

U.S. Pat. No. 3,340,039 Marceau

U.S. Pat. No. 3,613,930 Lippmann

U.S. Pat. No. 3,745,709 Perina

U.S. Pat. No. 4,034,697 Russell

U.S. Pat. No. 4,046,439 Lee

U.S. Pat. No. 4,270,311 Palomar

U.S. Pat. No. 4,414,777 Masacchia

U.S. Pat. No. 4,449,588 Benlolo et al

U.S. Pat. No. 5,318,145 Vollimer

U.S. Pat. No. 5,350,613 Deprez et al

Of the aforementioned patents, the most pertinent appear to be the following:

U.S. Pat. No. 4,034,697 to Russell is directed to a fire extinguisher cabinet. As shown in FIGS. 1 and 2, the fire extinguisher cabinet houses a fire extinguisher F which is illustrated positioned on a bottom 10 of a rectangular cabinet including top and side walls 11 and 12, respectively, and a back panel 13. A transparent slidable front panel 15 is movably positioned in the in-turned channels 14 and held in a position closing the front of the fire extinguisher cabinet by a manually movable latch 16 mounted on the bottom 10 of the cabinet. A key actuated cylinder lock assembly 17 is positioned in an aperture in the upper right hand side portion of the transparent slidable front panel 15 and arranged to move an actuating arm 18 in an arc based on the axis of the cylinder lock assembly 17.

U.S. Pat. No. 3,613,930 to Lippmann is directed to easily disintegratable structures. FIG. 1 illustrates a container or ampule 10 comprising a main cylindrical body portion 11 surrounding the cavity 12 in which various fluids or gases may be stored. The main body portion 11 is formed of a frangible material which is extremely strong and resistant to breakage during normal use, but will completely disintegrate when the narrow extension or tip 13 is broken. It is preferred that the frangible material be made of tempered glass. The frangible house 10 may serve as a fire extinguisher whereby extinguishing material of any suitable gas, liquid or solid is loaded into the cavity 12.

U.S. Pat. No. 5,350,613 to Deprez et al is directed to safety window panes made of laminated glass and processes for their manufacture. The window pane includes two glasses made of annealed, hardened or quenched glass 1, 2, bonded to one another by an insert sheet of synthetic material 3 to the opposite faces of which the glasses are adhesively attached. The sheet includes in the material a line 4 of discontinuity and mechanical strength of relatively small width. The line defines an outline of pre-opening of a surface area such that after breaking of the glasses 1 and 2 and rupture along the outline, it offers a sufficient passage for a human body.

U.S. Pat. No. 4,414,777 to Masacchia is directed to a break-away wall structure. The break-away wall structure includes a door panel aligned edge-to-edge with a wall panel. The wall panel is locked in place by spring loaded plungers which can be actuated by a handle kept for normal use. The vertical handle 71 is rigidly mounted on the end of the lug 67. Thus, the handle 71 rigidly connected to the crescent-shaped lever plate 63. By rotation of the crescent-shape lever plate 63 by movement of the handle 71 toward the levers 59, the crescent-shaped lever plate 63 will rotate about the pin 65, thereby pulling the bar 61 toward the handle 71. When the bar 61 is pulled toward the handle 71, the levers 59 will also move toward the handle 71 and the arms 53 as well as the rods 51 secured to the arms 53 will thereby pull the plungers 45 and 47 back from the frame 11, thus permitting the wall panel 23 to be opened.

U.S. Pat. No. 3,340,039 to Marceau is directed to a glass tempering apparatus with resilient sheet support means. This invention relates to tempering of sheet glass, and more particularly to means to move a sheet of glass smoothly between the air blasts that are used to temper the glass and hold them accurately in position.

Based upon the foregoing, it may be seen that there is still an ongoing need for a fire access panel of the type using a glass pane to permit visual observation of the interior contents thereof and which provides access to such interior contents only by way of breaking the glass pane during a fire emergency and wherein the user is less subject to inadvertent injury due to a severe laceration on a shard of broken glass that is normally encountered in such prior art devices. More specifically, there is a need for an improved safety fire access panel of the type using a glass pane wherein breakage of the glass to gain access to the contents therein may be more readily accomplished without the necessity of actually striking the glass and wherein the resultant broken glass is shattered into such small glass pieces that there is no likelihood of a severe laceration as would be the case in the prior art.

SUMMARY OF THE INVENTION

The present invention meets the aforementioned need by providing an improved fire access panel in which there are significant features that are believed to be novel and distinguishable over the prior art. More specifically, in the present invention, the glass pane of a fire equipment access panel is replaced by tempered glass as opposed to conventional annealed glass panes of the type available in the prior art.

Normally, when glass objects are manufactured, there is a temperature differential between the surface and interior layers of a formed glass object created upon cooling and causing temporary stresses. When such stresses exceed the tensile strength of the glass, fracturing can occur. Glass makers avoid permanent stresses by using carefully controlled cooling from a little below the annealing point to the strain point. This is called the annealing range. In annealing, the temperature of the glass is increased to near the softening point, after which it is slowly cooled through the annealing range, followed by more rapid cooling.

In tempering, rapid cooling is applied to the glass surfaces at a temperature slightly below the softening point. Because high permanent stress is purposely induced in the glass, tempering is the reverse of annealing. Tempering places the surfaces of the glass in a higher degree of compression while balancing tensile forces are confined to the interior. Because of the high degree of permanent stress induced in the glass by tempering, if any portion of the tempered glass is weakened, such as by cracking even an edge thereof, the entire structure virtually disintegrates into a large plurality of small, relatively harmless pieces, leaving no significant size shards of glass that might otherwise injure one's hand or arm reaching through the shattered glass to gain access to the interior of a cabinet for example. On the other hand, because annealed glass is not subject to such stresses, merely breaking an edge thereof does not accomplish the thorough shattering that one realizes with tempered glass. Consequently, the prior art use of annealed glass in fire access panels also requires the use of an object such as a small metal hammer to allow a user to break the glass by striking it at various locations along the entire surface area and even then it is entirely unlikely that all large sharp edges of glass shards will be avoided.

Consequently, the present invention substitutes tempered glass for annealed glass and moreover substitutes an edge breaking device for a metal hammer. An edge breaking device provides a simple and convenient means for exploiting the high stresses built into tempered glass and produces the virtual disintegration of the glass panel even though only an edge portion thereof has been fractured.

OBJECTS OF THE INVENTION

It is therefore a principal object of the present invention to provide a safety improved fire access panel of the type requiring destruction of a glass pane to gain access to the interior thereof and which overcomes the disadvantages of the prior art by assuring that there are no large glass shards that might otherwise lacerate the hand or arm of a user in attempting to gain access through the broken pane.

It is still an additional object of the present invention to provide a safety improved fire access panel of the type having a glass pane that must be destroyed to gain access to an interior of the panel enclosed cabinet and the like, whereby the glass pane is made of tempered glass which, when destroyed, leaves no large shards of glass that could otherwise lacerate someone.

It is still an additional object of the present invention to provide a safety improved fire access panel of the type having a glass pane that must be destroyed to gain access to an interior of a cabinet enclosed by the panel wherein the pane is made of tempered glass and is provided with an edge grasping device which may be used to crack the edge of the tempered glass pane, thereby destroying the entire pane without leaving any large glass shards that might otherwise lacerate one attempting to gain access thereto.

It is still an additional object of the invention to provide a breakable glass structure for transparently enclosing an emergency equipment storage area access to which is gained by breaking the glass structure, the structure comprising a pane of tempered glass and a lever positioned along an edge of the glass pane and configured for breaking the edge upon rotation of the lever.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF PREFERRED EMBODIMENTS

Figure 1:
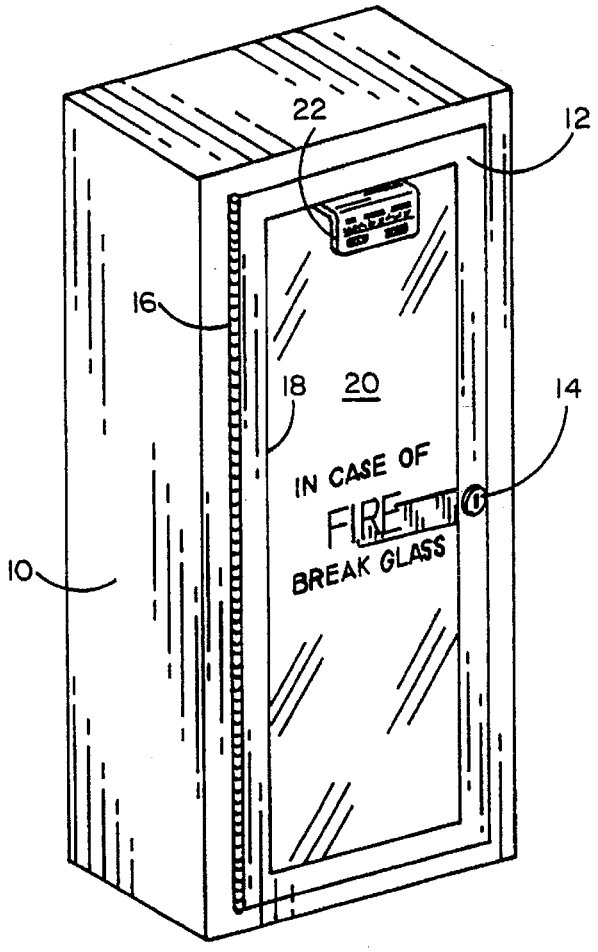
FIG. 1 is a three dimensional view of a fire extinguisher cabinet using the safety features of the present invention.

Referring now to the accompanying drawings, it will be seen that a fire equipment cabinet 10 comprises a door 12 which is normally secured by a lock 14 and an elongated hinge 16. Door 12 comprises a metal frame 18 which fully surrounds a glass pane 20. It will be understood that the cabinet 10 is of the type which may normally house a fire extinguisher or a fire department valve and hose or any other combination of various types of fire protection equipment to which occupants of a building or members of the general public can gain access by simply breaking the glass.

As previously indicated, normally such glass panes are made of annealed glass and cabinets, such as cabinet 10, are provided with a metal hammer-like device which is attached to the cabinet adjacent the glass to permit the user to gain access to the interior of the cabinet by using the hammer to break the glass. However, in the present invention, the glass pane 20 is made of tempered glass and in addition, the present invention provides a glass breaking lever 22 which is typically made of steel and is designed to capture the side or edge of the glass from three sides using a U-shaped channel and a small screw on the rear side to secure the glass breaking device to the glass in a firm manner.

Figure 2:
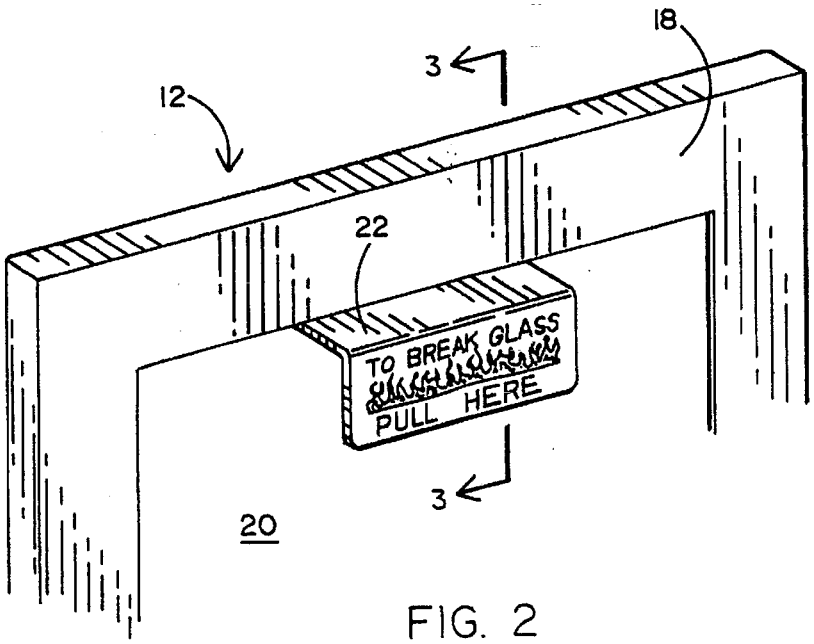
FIG. 2 is an enlarged view of the upper portion of the front of the cabinet of FIG. 1, illustrating the improvements thereto.
Figure 3:
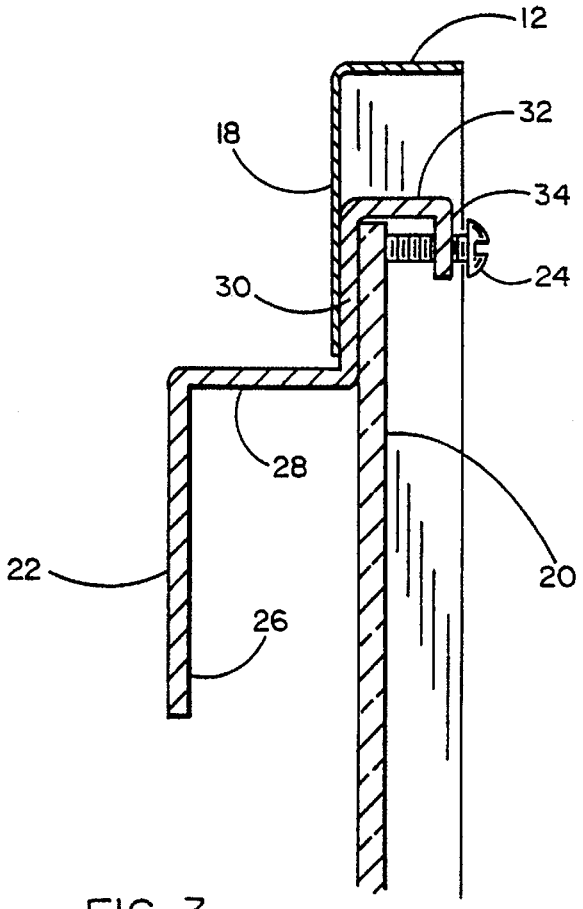
FIG. 3 is a partially cross-sectioned side view taken along lines 3—3 of FIG. 2 and illustrating the glass and lever of the present invention.
Figure 4:
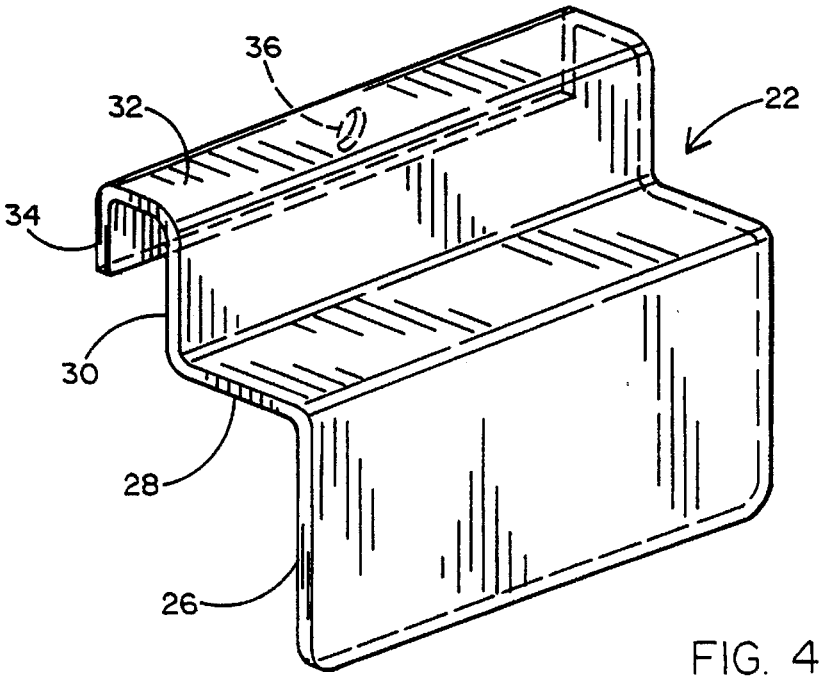
FIG. 4 is a three dimensional view of the glass breaking lever of the invention.

The glass breaking lever 22 and its relationship to the glass pane 20 may be better understood by referring to FIGS. 2, 3 and 4. As seen in FIG. 2, the glass breaking lever 22 is mounted in a manner which allows a portion thereof to protrude from the door 12 in a cantilevered fashion along an edge of the frame 18 and glass pane 20 so that it is readily accessible. As seen in FIGS. 3 and 4, the glass breaking lever 22 is comprised of five distinct planar surfaces, including surface 26, surface 28, surface 30, surface 32 and surface 34. Surface 26 bears the indicia shown in FIG. 2, instructing the user to pull the lever 22 to break the glass. Surface 28 provides a convenient spacing between the surface 26 and the glass pane 20 to permit the user to place his or her fingers between the pane 20 and the surface 26. Surface 30 is positioned between the tempered glass pane 20 and the frame 18, extending the glass breaking lever to the upper edge of the tempered glass pane 20. Surface 32 extends rearward within the frame 18, immediately adjacent the edge of the tempered glass pane 20 and surface 34 comprises an aperture 36 through which a retaining screw 24, shown in FIG. 3, is secured to more reliably affix the glass breaking lever to the tempered glass pane 20 along the edge thereof. Thus it is seen in FIGS. 3 and 4 that the glass breaking lever 22 effectively wraps around the tempered glass pane 20 along an edge thereof, so that when a user pulls on the surface 26, the lever will tend to break the edge of the glass pane 20 around which it is wrapped, as seen best in FIG. 3. Furthermore, as previously described, upon breaking an edge of tempered glass, the glass will shatter into small harmless pieces because of the built-in stresses inherent in tempered glass.

It will now be understood that what has been disclosed herein comprises a hand actuated mechanical device used to safely and dependably break tempered glass in a fire equipment cabinet to allow access to the enclosed fire protection equipment. The device is incorporated in a door and obviates the requirement for striking the glass by means of any additional striking tool or object. The glass breaking device of the invention attaches directly to tempered glass at an outermost edge thereof and is accessible from the front side of the cabinet. The device is actuated by pulling on a protruding lever clearly labelled to describe how to hand activate the device and break the glass in case of fire. The glass breaking lever is preferably made of steel and captures the edge of the glass from three sides, using a U-shaped channel and a small screw to secure the glass breaking device to the glass in a firm manner. The actuating arm of the device protrudes toward the front of the cabinet far enough to allow a person's fingers to fit between the device and the door. The glass breaking device is pulled in case of a fire, rotating it around the edge of the tempered glass which then shatters into small, harmless pieces as a result of the inherent nature of built-in stresses in tempered glass. As a result, the present invention permits access to the interior of a glass pane protected fire equipment cabinet during emergencies while avoiding the prior art hazard of large sharp shards of glass which might otherwise lacerate the arm or hand of a user.

Those having skill in the art to which the present invention pertains, will now as a result of the applicant's teaching herein, perceive various modifications and additions which may be made to the invention. By way of example, the precise manner for grasping and breaking an edge of a tempered glass pane shown herein, may be readily modified to provide a number of alternative structures for performing such a function. It should be understood that the glass breaking device shown herein is of an exemplary and illustrative nature only. Accordingly, all such modifications and additions are deemed to be within the scope of the invention which is to be limited only by the claims appended hereto and their equivalents.

I claim:

1. In a fire equipment cabinet for containing equipment for a fire emergency and having a door providing a glass pane to permit observation of the enclosed equipment; an improved door comprising:

a glass pane comprising tempered glass;

a frame enclosing said glass pane; and a lever positioned along an edge of said glass pane adjacent said frame and configured for breaking an edge of said glass pane upon rotation of said lever.

2. The improved door recited in claim 1 wherein said lever comprises at least one surface cantilevered from said glass pane for grasping and rotating said lever to break said glass pane.

3. The improved door recited in claim 1 further comprising a fastener securing said lever on said edge of said glass pane.

4. A breakable glass structure for transparently enclosing an emergency equipment storage area access to which is gained by breaking the glass structure; the structure comprising:

a pane of tempered glass; and a lever positioned along an edge of said glass pane and configured for breaking a portion of said edge upon selective rotation of said lever.

5. The breakable glass structure recited in claim 4 wherein said lever comprises at least one surface cantilevered from said glass pane for grasping and rotating said lever to break said glass pane.

6. The breakable glass structure recited in claim 4 further comprising a fastener securing said lever on said edge of said glass pane.

* * * * *